United States Patent [19]

Parlatore et al.

[11] Patent Number: 4,843,200

[45] Date of Patent: Jun. 27, 1989

[54] SWITCH MECHANISM HAVING A CONDUCTIVE CONTACT ARM WITH A DOUBLE PIVOT

[75] Inventors: Roger Parlatore; Alain Leluc, both of Solignac; Christian Besse, Limoges, all of France

[73] Assignee: Legrand, Limoges, France

[21] Appl. No.: 113,136

[22] Filed: Oct. 27, 1987

[30] Foreign Application Priority Data

Oct. 29, 1986 [FR] France ..... 86 15041

[51] Int. Cl.[4] ..... H01H 23/24

[52] U.S. Cl. ..... 200/553; 200/339; 200/461

[58] Field of Search ..... 200/68.2, 68.1, 67 R, 200/339, 67 A, 67 D, 76

[56] References Cited

U.S. PATENT DOCUMENTS

| | | | |
|---|---|---|---|
| 2,203,555 | 6/1940 | von Hoorn | 200/68.2 |
| 2,782,279 | 2/1957 | Heusser | 200/68.2 |
| 3,337,703 | 8/1967 | Yamada | 200/67 R |
| 3,632,921 | 1/1972 | Korsgren | 200/76 |
| 3,735,077 | 5/1973 | Ohashi | 200/68.2 |
| 3,944,764 | 3/1976 | Aryamane et al. | 200/68.2 |

FOREIGN PATENT DOCUMENTS

| | | | |
|---|---|---|---|
| 632699 | 12/1961 | Canada | 200/67 D |
| 2319524 | 11/1973 | Fed. Rep. of Germany | 200/67 D |
| 2259052 | 6/1974 | Fed. Rep. of Germany | 200/339 |
| 3616526 | 11/1986 | Fed. Rep. of Germany | 200/339 |
| 2268343 | 11/1975 | France . | |
| 468510 | 1/1952 | Italy | 200/67 D |

*Primary Examiner*—Renee S. Luebke

*Attorney, Agent, or Firm*—Charles E. Brown; Charles A. Brown

[57] ABSTRACT

A switch mechanism comprises, movably mounted between a fixed yoke and at least one fixed contact, at least one conductive contact arm which is articulated to the fixed yoke, which is itself conductive. The arm is controlled by an operating member available to the user to assume one or other of at least two positions in one of which it bears against the fixed contact through a bearing area and in the other of which it is spaced from the latter. A double pivot is used for articulating the conductive contact arm to the fixed yoke, which comprises two separate pivoting areas parallel to each other, one for each of said two positions of the conductive contact arm. The conductive contact arm itself comprises two distinct contact areas for cooperating each with a respective one of the pivoting areas.

20 Claims, 4 Drawing Sheets

FIG. 11
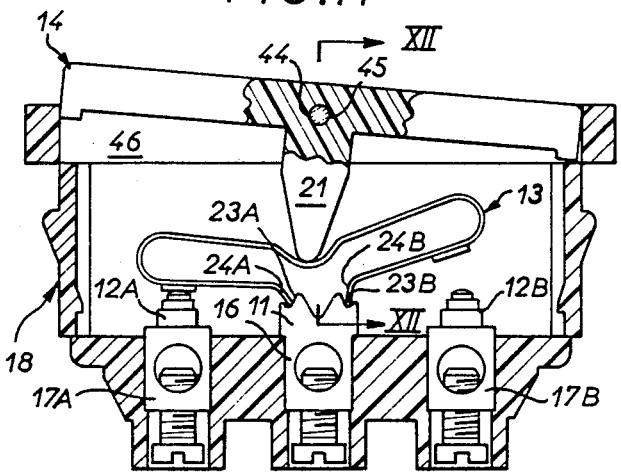
FIG. 12
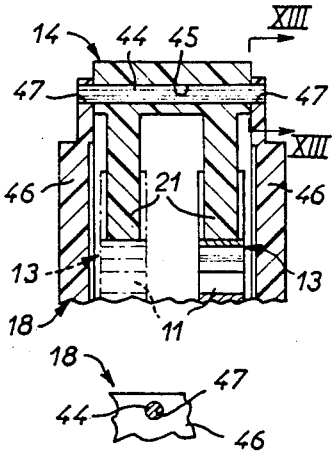
FIG. 13
FIG. 14
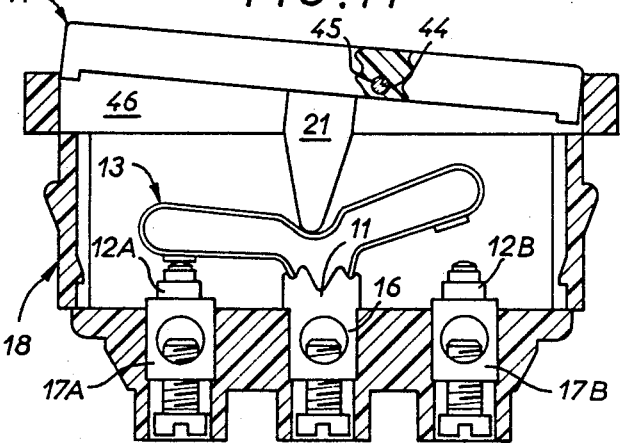
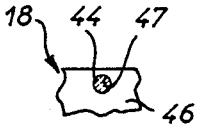
FIG. 15
FIG. 16
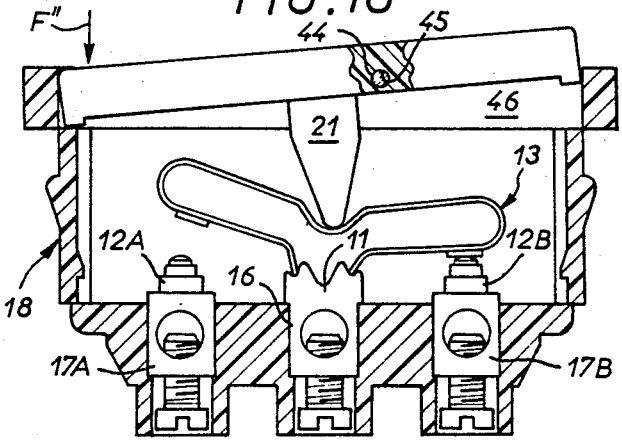

SWITCH MECHANISM HAVING A CONDUCTIVE CONTACT ARM WITH A DOUBLE PIVOT

BACKGROUND OF THE INVENTION

1. Field of the Invention

The present invention is generally concerned with switches of the type usually employed to control the supply of electrical power to a circuit of any kind.

2. Description of the Prior Art

Generally speaking, a switch of this kind comprises a set of parts usually referred to as the mechanism and which constitute its active part inside a housing and controlled by an operating member such as a pivoting toggle or a pushbutton, for example, accessible to the user operating the switch.

The present invention is more particularly directed to the case where a mechanism of this kind comprises, movably mounted between a fixed yoke and at least one fixed contact, at least one conductive contact arm which is articulated to the fixed yoke, which is itself conductive, and which is controlled by the associated operating member to assume one or other of two positions in one of which it bears against the fixed contact, through a bearing area, and in the other of which it is spaced from the latter either because, in the case of a single-throw switch, it is not then bearing against any other fixed contact or bears against a "rest", or because, in the case of a double-throw switch, it bears against another fixed contact in this second position.

One problem in manufacturing switch mechanisms of this type concerns the articulation to be obtained between the conductive contact arm and the fixed yoke given that, over and above its pivoting function, this articulation also has to transmit current.

At present this articulation is achieved by means of a single pivot.

In practice the fixed yoke usually comprises to this end a pivoting area and the conductive contact arm itself comprises, for cooperating with this pivoting area, by means of a knife-edge articulation, for example, an area which will be referred to hereinafter for convenience only as the contact area, this area normally remaining in permanent contact with the pivoting area of the fixed yoke.

In fact it appears that in operation, that is to say during actuation of the mechanism, unwanted rebounds occur in the articulation between the contact area of the conductive contact arm and the pivoting area of the fixed yoke.

Each rebound in practice results in arcing between the contact area of the conductive contact arm and the pivoting area of the fixed yoke, which leads to gradual deterioration of the conductive contact arm and/or the fixed yoke to the detriment of the required transmission of current.

The conductive contact arm is subject to progressive oxidation of its surface, for example, and where it is made from brass it is also subject to structural changes due to migration of zinc towards its surface.

As the conditions under which current is transmitted are then modified, there inevitably results unwanted overheating between the conductive contact arm and the fixed yoke which, independently of any deleterious effect on the mechanical strength of the surrounding insulative material, can only accentuate the deterioration of which it is a sign.

An attempt is usually made to remedy this disadvantage by applying grease to the articulation area concerned, but this remedy is inadequate.

A general objective of the present invention is an arrangement providing a simple and effective way to overcome this difficulty which also yields other advantages.

SUMMARY OF THE INVENTION

In one aspect, the invention consists of a switch mechanism comprising an electrically conductive fixed yoke, at least one fixed contact, at least one electrically conductive contact arm articulated to said fixed yoke, an operating member available to the user and adapted to move said contact arm to one or other of at least two positions in one of which it bears against said fixed contact through a bearing area and in the other of which it is spaced from the latter, in which switch mechanism a double pivot is used for articulating said conductive contact arm to said fixed yoke, said fixed yoke comprising two separate pivoting areas parallel to each other, one for each of said two positions of said conductive contact arm, said conductive contact arm itself comprising two distinct contact areas for cooperating each with a respective one of said pivoting areas.

In another aspect, the invention consists of a switch comprising, in a housing, a switch mechanism as defined in the preceding paragraph and, available to the user, an operating member adapted to actuate said switching mechanism.

In essence, the switch mechanism in accordance with the invention is characterised by the use of a double pivot for articulating the conductive contact arm to the fixed yoke.

There results significant attenuation if not total elimination of the consequences inherent to any rebound in operation of the conductive contact arm relative to the fixed yoke at the level of a pivot of this kind.

Assuming that a rebound occurs at one of the two pivots employed, there is every chance that for the other pivot the contact area of the conductive contact arm will still be in effective bearing engagement against the corresponding pivot area of the fixed yoke which, as electrical continuity is assured in this way between the conductive contact arm and the fixed yoke in any event, minimises the risk of arcing between these members.

Conjointly with this, the risk of unwanted overheating between the conductive contact arm and the fixed yoke is itself minimized, as much due to the use of a double pivot, which results in a doubling of the contact surface area, as from the fact that, related to the use of this double pivot, the conductive contact arm offers a larger surface area of interchange with the surrounding atmosphere, which is obviously favorable to good dissipation of heat.

Other things being equal, a switch mechanism with a double-pivot conductive contact arm in accordance with the invention is advantageously adapted to switch higher currents than a comparable switch mechanism comprising only one pivot for articulating its conductive contact arm.

There is undoubtedly described in the French patent application filed under the No. 74 13557 and published under the No. 2 268 343 an electrical switch in which the fixed yoke comprises two pivoting areas and in which the conductive contact arm correspondingly comprises two contact areas.

In this French patent, however, these pivoting and contact areas do not contact the double pivot.

For each position of the conductive contact arm there is only one contact area of the conductive contact arm engaged with the corresponding pivoting area of the fixed yoke, with the risk of rebound as previously mentioned.

The same applies to the electrical switches described in U.S. Pat. Nos. 2,203,555 and 3,337,703.

In contradistinction to this, with the double pivot in accordance with the invention the two contact areas of the conductive contact arm are, ignoring any rebounds, both in permanent contact with the pivoting areas of the fixed yoke, irrespective of the position of the conductive contact arm.

In one preferred embodiment of the invention the conductive contact arm has a generally looped configuration so as to advantageously confer on it sufficient elasticity for it to be able of itself to control the position and/or the return movement of the associated operating member.

A loop configuration of this kind is undoubtedly known in itself for the conductive contact arm of a switch mechanism.

However, in this instance it is advantageously conjugate with the use of two pivots for the conductive contact arm.

In accordance with the invention the loop that a conductive contact arm of this kind forms is an open loop and closes on the fixed yoke, its ends forming of themselves the corresponding contact areas of the conductive contact arm.

An advantageous result of this is great simplicity of construction.

The characteristics and advantages of the invention will emerge from the following description given by way of example with reference to the appended schematic drawings.

BRIEF DESCRIPTION OF THE DRAWINGS

FIG. 11 is a view in elevation and cross-section showing the FIG. 5 embodiment in a more constructive form.

FIG. 12 is a partial view of this embodiment in transverse cross-section of this embodiment on the line XII—XII in FIG. 11.

FIG. 13 is a partial view of it in elevation and cross-section on the line XIII—XIII in FIG. 12.

FIG. 14 is a view in elevation and cross-section analogous to that of FIG. 11 for another embodiment.

FIG. 15 is a view in elevation and cross-section analogous to that of FIG. 13 for this embodiment.

FIG. 16 is a view in elevation and cross-section analogous to that of FIG. 14 which illustrates the use of this embodiment.

DESCRIPTION OF THE PREFERRED EMBODIMENTS

As shown in these Figures the switch mechanism in accordance with the invention generally comprises, in a manner that is known per se, movably mounted between a fixed yoke 11 and at least one fixed contact 12A, 12B, a conductive contact arm 13 which is articulated to the fixed yoke 11, which is itself conductive, and which is controlled by an operating member 14 available to the user to assume one or other of two positions in one of which (FIG. 1) it bears through a bearing area 15A, 15B against the fixed contact concerned and in the other of which (FIG. 4) it is spaced from the latter.

Figure 1:
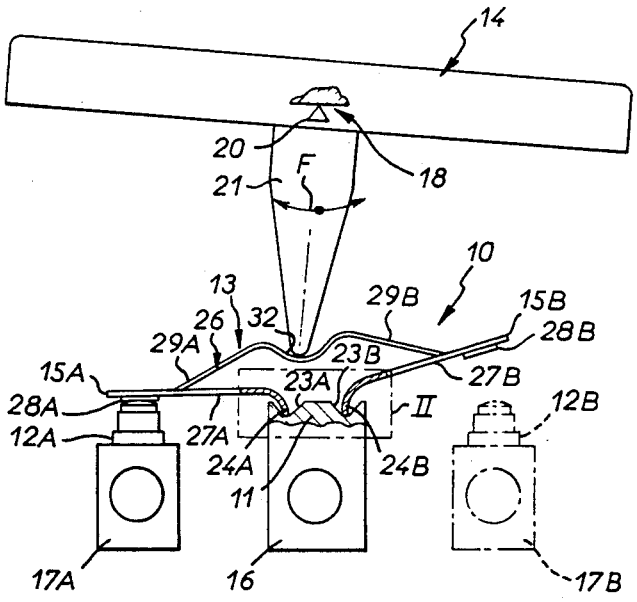
FIG. 1 is a locally cut away view in elevation of a switch mechanism in accordance with the invention for one position of the conductive contact arm that it comprises.
Figure 2:
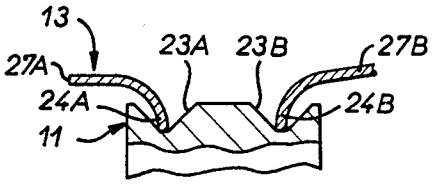
FIG. 2 shows to a larger scale the detail of FIG. 1 marked by a box II in FIG. 1.
Figure 3:
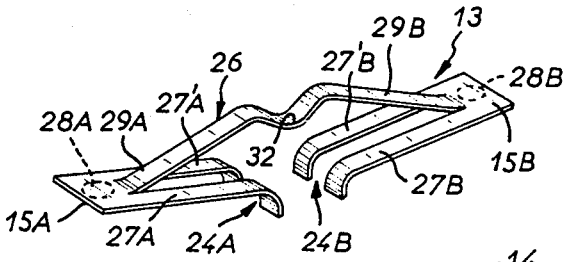
FIG. 3 is a perspective view of the corresponding conductive contact arm.
Figure 4:
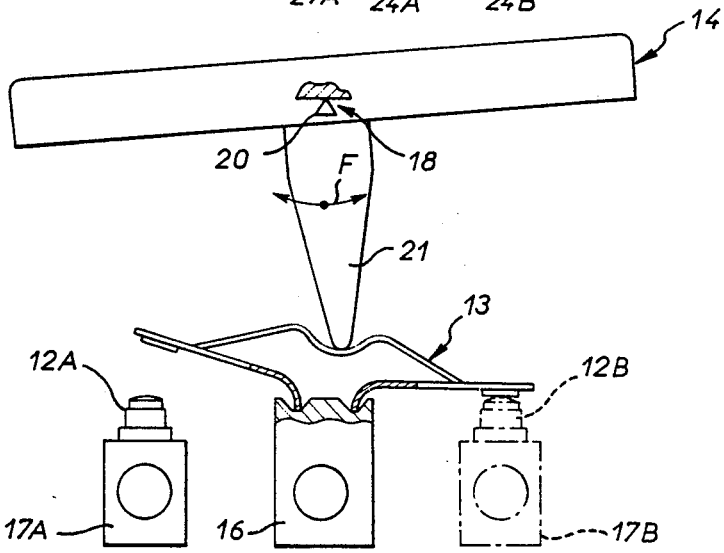
FIG. 4 is a view in elevation analogous to that of FIG. 1, for the other position of the conductive contact arm.

In a way that is known per se, and in the case of a single-throw switch, there may be only one contact, for example a contact 12A as shown in full outline in FIGS. 1 and 4.

In the case of a double-throw switch, however, and as schematically represented in dashed outline in FIGS. 1 and 4, there may be provided on the side of the yoke 11 opposite the previously mentioned contact 12A a second contact, in this instance a contact 12B.

In the case of a single-throw switch a contact 12B of this kind may also be provided but is then merely a "rest" with no active contribution to the circuit to which the supply of electrical power is to be controlled.

Be this as it may, for the purposes of inserting them into a circuit of this kind the yoke 11, on the one hand, and the contact 12A, on the other hand, are each connected to a respective connecting terminal 16 and 17A.

The same applies in practise to the contact 12B, this contact 12B being also connected to a connecting terminal 17B so as to be usable as an active contact if required.

In the embodiment specifically shown in FIGS. 1 through 4, the yoke 11 and the contacts 12A, 12B are in on piece with their respective connecting terminals and the corresponding parts are in practise solid parts appropriately cut out, machined or die-stamped.

It will be understood that the switch mechanism 10 constituted in this way is placed in an insulative material housing.

As this housing does not of itself form part of the present invention and is within the competence of those skilled in the art it will not be described here.

Nor is it shown in FIGS. 1 through 10, for the most part.

Only certain parts of this housing necessary to the description are visible in certain of these Figures.

They are all designated by the same reference number 18.

On the other hand, the housing is seen more clearly and more completely, with the same reference number 18, in FIGS. 11 through 22.

In the embodiment specifically shown in FIGS. 1 through 4, and this applies also to the embodiments shown in FIGS. 5 through 8, the operating member 14 is a toggle which by means of lateral trunnions 20, of triangular or circular transverse contour, for example, is mounted on the housing 18 to pivot as shown by the circular double-headed arrow F; by means of a finger 21 it is adapted to operate on the conductive contact arm 13, the finger 21 to this end projecting from its lower surface, substantially perpendicular thereto, and having a tapered and rounded end where it contacts said conductive contact arm 13.

These arrangements are well known in themselves and as they do not of themselves constitute an object of the present invention they will not be described in more detail here.

In accordance with the invention a double pivot is used for articulating the conductive contact arm 13 to the fixed yoke 16.

To this end the fixed yoke 16 comprises in practise two distinct, parallel pivoting areas 23A, 23B for the two positions of the conductive contact arm 13, said conductive contact arm 13 itself comprising two distinct contact areas 24A, 24B for cooperating each with a respective one of said pivoting area 23A, 23B.

In the embodiment specifically shown in FIGS. 1 through 4, the pivoting areas 23A, 23B of the fixed yoke 11 are both oriented in the same direction, upwards in this instance, both being on the same side of the yoke 11, in this instance on the front surface of the massive part which forms the latter and the associated connecting terminal 16.

In practise each of these pivoting areas 23A, 23B is simply formed, in a way that is known per se, by a groove of V-shape transverse cross-section recessed into the yoke 11.

As shown here, for example, each of these grooves has its bottom edge levelled off by a plane surface.

Given the upwards orientation of the grooves which in this way constitute the pivoting areas 23A, 23B of the yoke 11, the corresponding contact areas 24A, 24B of the conductive contact arm 13 are curved towards these pivoting areas 23A, 23B.

In the embodiments shown in FIGS. 1 through 6, 9, 10 and 11 through 22 the conductive contact arm 13 has in practise an overall looped configuration, but the loop that it forms is an open loop and closes onto the fixed yoke 11, its ends forming of themselves the corresponding contact areas 24A, 24B.

The open loop that the conductive contact arm 13 forms in this way is in practise in one piece formed from a single metal strip by appropriate cutting and bending; in the embodiments shown in FIGS. 1 through 6, 9 and 11 through 22, it is symmetrical relative to its central part.

To be more precise, in the embodiment specifically shown in FIGS. 1 through 4, the conductive contact arm 13 comprises, on the one hand between two bearing areas 15A, 15B each adapted to bear on the corresponding contact 12A, 12B, a median strip 26 through which it is controlled by the associated operating member 14 and which, common to said bearing areas 15A, 15B, extends continuously from one to the other of the latter, and, on the other hand, each set back relative to said median strip 26 at the ends thereof, at least one tab 27A, 27B the end of which forms the corresponding contact area 24A, 24B.

For each of these contact areas 24A, 24B, the conductive contact arm 13 in practise comprises, in this embodiment, two tabs 27A-27'A, 27B-27'B, disposed each on one respective side of its median strip 26 and parallel to each other; the ends of these tabs 27A-27'A, 27B-27'B conjointly form the corresponding contact areas 24A, 24B.

In this embodiment, the bearing areas 15A, 15B of the conductive contact arm 13 are in practise plane and each carries projecting from its lower surface a contact bead 28A, 28B to contact the corresponding fixed contact 12A, 12B and each of the tabs 27A-27'A, 27B-27'B the ends of which conjointly form a contact area 24A, 24B is continuous with the corresponding bearing area 15A, 15B, the main part at least of a tab 27A-27'A, 27B-27'B lying substantially in the plane of said bearing area 15A, 15B, except that the associated median strip 26 is generally M-shaped with rounded corners, whichever of the legs 29A, 29B of this median strip 26 which corresponds to a bearing area 15A, 15B diverging from the plane thereof.

It is of course on the concave middle part 32 of this median strip 26 that the finger 21 of the toggle constituting the operating member 14 bears.

Given the elasticity conferred on it by its loop shape, the conductive contact arm 13 is then prestressed.

This results in resilient control over the position of the operating member 14.

In other words, the operating member 14 is stable in both its positions.

The same therefore goes for the conductive contact arm 13.

To move the conductive contact arm 13 from one of its positions to the other it suffices to operate appropriately the operating member 14, in order to tilt it about the axis of its trunnions 20 as shown by the double-headed arrow F in FIGS. 1 and 4.

For the FIG. 1 position the conductive contact arm 13 establishes electrical continuity between the fixed yoke 11 and the fixed contact 12A and therefore between the corresponding connecting terminals 16 and 17A, and for the FIG. 4 position it establishes electrical continuity between the fixed yoke 11 and the fixed contact 12B, and thus between the corresponding connecting terminals 16 and 17B.

As will be noted, and in accordance with the invention, for each of these positions the conductive contact arm 13 is engaged through both of its contact areas 24A, 24B with the respective and corresponding pivoting areas 23A, 23B of the fixed yoke 11.

Figure 5:
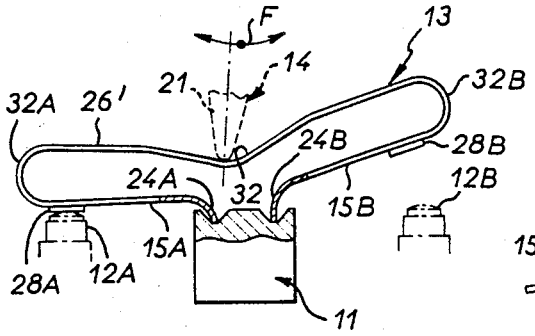
FIGS. 5 through 9 are views which reproduce that of FIG. 1 in part, each relating to a respective embodiment of the switch mechanism in accordance with the invention.

In the embodiment shown in FIG. 5, the conductive contact arm 13 comprises, as previously, a median strip 26' through which it is adapted to be operated by the associated operating member 14, by means of the finger 21 of the latter, but in this case it further comprises, as a variation on the previously described set-back arrangement, two U-shaped connecting areas 32A, 32B through each of which a corresponding end of the median strip 26' merges continuously with the corresponding contact area 24A, 24B, one branch of at least one of these connecting areas 32A, 32B and in the case of a single-throw switch, for example, one of the branches of each of the latter, that on the side opposite the median strip 26', being then adapted to form directly and of itself a bearing area 15A, 15B for the whole.

For the rest, the arrangements are as previously described.

Figure 8:
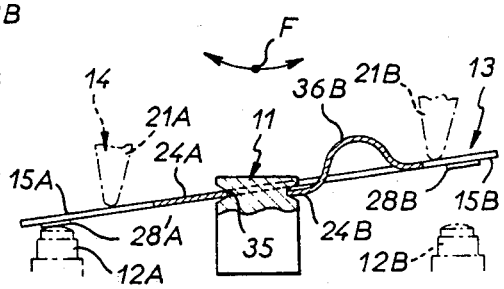
Figure 6:
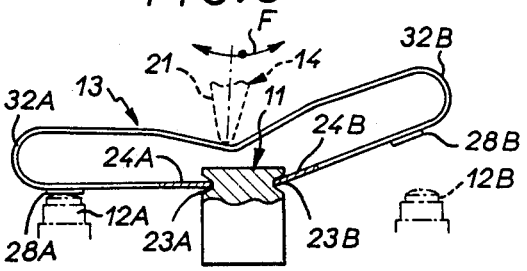

In the embodiment specifically shown in FIG. 8, a curved tab 36B is provided only for the contact area 24B of the conductive contact arm 13, the other contact area 24A of the latter being formed directly by the edge of its cut-out 35, to be more precise by the edge of the corresponding transverse edge surface of the latter.

Figure 7:
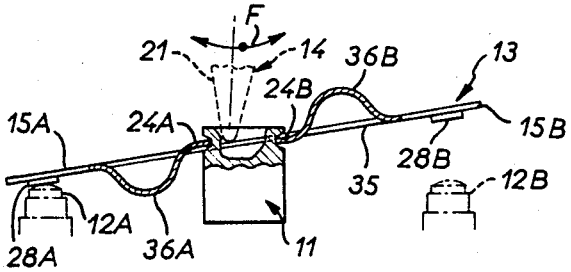

In the embodiment schematically shown in FIG. 7, the finger 21 of the operating member 14 forms a yoke the two arms of which each bear on a respective one of the corresponding longitudinal edges of the conductive contact arm 13.

Alternatively (FIG. 8) two fingers 21A, 21B are provided on the operating member 14, one on each respective side of the yoke 11.

In both cases it is not necessary for the cut-out 35 in the conductive contact arm 13 to have a closed contour.

It could equally well be a U-shaped cut-out, for example, by which is meant a cut-out open laterally along one of the longitudinal edges of the conductive contact arm 13.

In the foregoing the operating member 14 consists of a toggle mounted to pivot.

Figure 9:
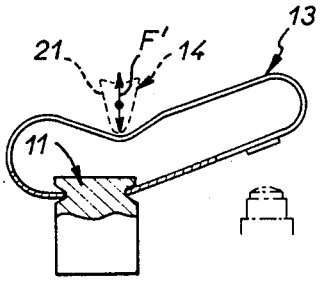

However, as schematically represented by a double-headed arrow F' in FIG. 9, it could equally well be a pushbutton mounted to move in translation in the corresponding housing.

In this case the corresponding pushbutton is offset relative to the fixed yoke 11 and the loop formed by the conductive contact arm 13 is asymmetric.

For the rest, however, the arrangements are of the kind described previously with reference to FIGS. 1 through 6.

In particular, the inherent elasticity of the conductive contact arm 13 is sufficient to apply the return force to the corresponding operating member 14, without there being any need to employ an additional spring for this purpose.

It goes without saying, however, that for a switch mechanism for which the operating member is a pushbutton, there is provided only one fixed contact, in this instance a fixed contact 12B.

Figure 10:
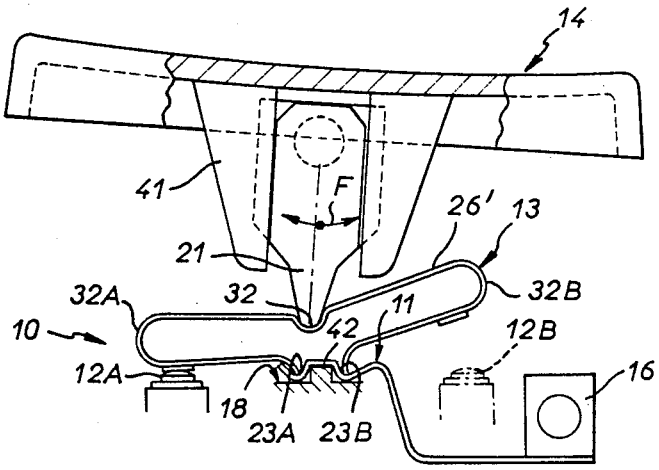
FIG. 10 is a view analogous to that of FIG. 1 which concerns another embodiment of the switch mechanism.

The embodiment shown in FIG. 10 is, taken overall, of the same kind as that shown in FIG. 5.

However, the action of the operating member 14 on the conductive contact arm 13 is obtained through the intermediary of a part 21, sometimes called the actuator, separate from the operating member 14.

The operating member 14 which is, as previously, a toggle mounted to pivot, is engaged through a yoke 41 with an actuator 21 of this kind and the latter is also pivotally mounted on the corresponding housing 18.

The axis of the trunnions of the operating member 14 is not necessarily coincident with that of the trunnions of the actuator 21 and only that of the latter needs to remain fixed relative to the fixed yoke 11.

These arrangements are well known in themselves and as they do not of themselves relate to the present invention they will not be described in more detail here.

For the rest, the arrangements are of the kind described previously.

However, in the embodiment shown the fixed yoke 11 with its pivoting areas 23A, 23B is no longer formed by a massive part but by a strip which is appropriately folded and also forms the associated connecting terminal 16, being appropriately located by the corresponding housing 18, a peg 42 of the latter being inserted between its pivoting areas 23A, 23B, for example.

Also, in the embodiment shown the convex median part 32 of the central strip 26' of the conductive contact arm 13 is matched to the rounded off end of the associated actuator 21 so as to nest over the latter.

The embodiments of FIGS. 11 through 22 are also, taken as a whole, of the same kind as that described with reference to FIG. 5.

They therefore comprise, in a housing 18, a fixed yoke 11, V-shaped contact areas 23A, 23B, two fixed contacts 12A, 12B, a conductive contact arm 13 of open loop configuration closing through its contact areas 24A, 24B onto the fixed yoke 11, and an operating member 14 in the form of a toggle mounted to pivot on the housing 18 and comprising a finger 21 for operating on the conductive contact arm 13.

In the embodiment shown in FIGS. 11 through 13, the operating member 14 is pivotally mounted by means of a pin 44 which passes transversely through the operating member 14 by means of a bore 45 provided in the latter to this end; its ends pass through the corresponding longitudinal walls 46 of the housing 18, by means of bores 47 provided in the latter also to this end.

The pivot pin 44 may be retained axially by means of a cap, for example, fitted over the operating member 14 and covering the latter and the relevant portions of the longitudinal walls 46 of the housing 18.

As the corresponding arrangement is not relevant to the present invention it will not be described in more detail here.

In the embodiment shown in FIGS. 11 through 13, the pivot pin 44 is on the same vertical line as the fixed yoke 11 so that, as previously, both positions of the operating member 14 are stable.

Only one of these positions is shown, that of FIG. 11.

The bores 47 in the housing 18 are circular, with the same contour as the pivot pin 44, and the same applies to the bore 45 in the operating member 14.

In the embodiment shown in FIGS. 14 through 16, the pivot pin 44 of the operating member 14 is, however, offset laterally relative to the fixed yoke 11.

In other words, it is offset towards one of the fixed contacts 12A, 12B, for example the fixed contact 12B as shown here.

The result is that only one of the positions of the operating member 14, and therefore of the conductive contact arm 13, is stable, namely that which, as shown in FIG. 14, corresponds to the bearing engagement of the conductive contact arm 13 on the fixed contact 12A opposite that on the side to which the pivot pin 44 is offset.

As a corollary to this, the other position of the operating member 14 and thus of the conductive contact arm 13 is unstable and to obtain it the corresponding action on the operating member 14 must be maintained as schematically represented by an arrow F'' in FIG. 16.

Figure 17:
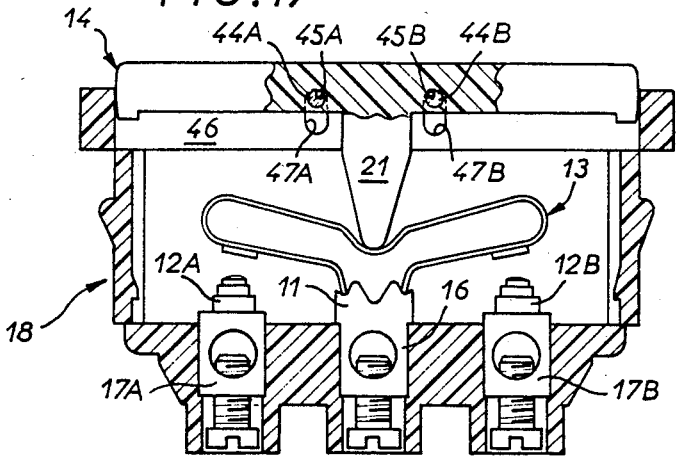
FIGS. 17 and 18 are views in elevation and cross-section respectively analogous to those of FIGS. 11 and 13 which relate to another embodiment.
Figure 18:
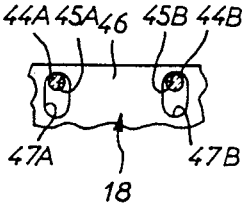
Figure 19:
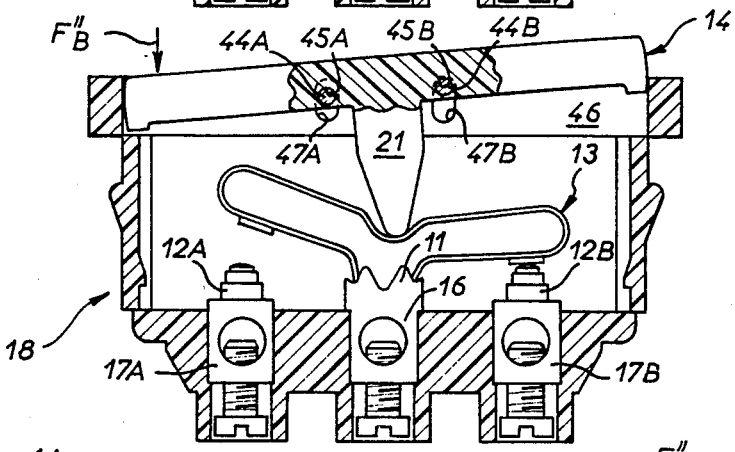
FIGS. 19 and 20 are views in elevation and cross-section analogous to that of FIG. 17 which illustrate the use of this embodiment.

In the embodiment shown in FIGS. 17 through 19 there are two pivot pins 44A, 44B each offset laterally relative to the fixed yoke 11 and each extending to each side of the latter, one offset towards the fixed contact 12A and the other offset towards the fixed contact 12B; each passes without clearance through bores 45A, 45B in the operating member 14 and with clearance through bores 47A, 47B in the housing 18.

As shown here, these bores 47A, 47B are then in practise elongated to form slots generally parallel to the transverse median plane of the assembly.

If required, these bores 47A, 47B may be slightly curved, in which case they are centered on the pin opposite that passing through them.

In practise, however, the simple provision of clearance is sufficient.

Figure 21:
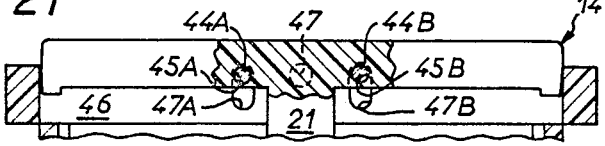
FIGS. 21 and 22 are partial views in elevation and cross-section respectively reproducing in part those of FIGS. 11 and 13 which relate to another embodiment.

With an embodiment of this kind the stable idle position of the operating member 14, and thus of the conductive contact arm 13, is an intermediate position between their previous extreme tilted positions and, for this intermediate position which is shown in FIG. 21 and is a third position in addition to the previous two positions, the conductive contact arm 13 is spaced from both of the fixed contacts 12A, 12B.

If, for example, as shown by the arrow F"B in FIG. 19 the operating member 14 is operated on the side of the fixed contact 12A, the operating member 14 pivots about the pivot pin 44B and the conductive contact arm 13 is then applied against the fixed contact 12B while at the same time, actuated by the operating member 14, the pivot pin 44A moves in the corresponding bore 47A in the housing 18.

Figure 20:
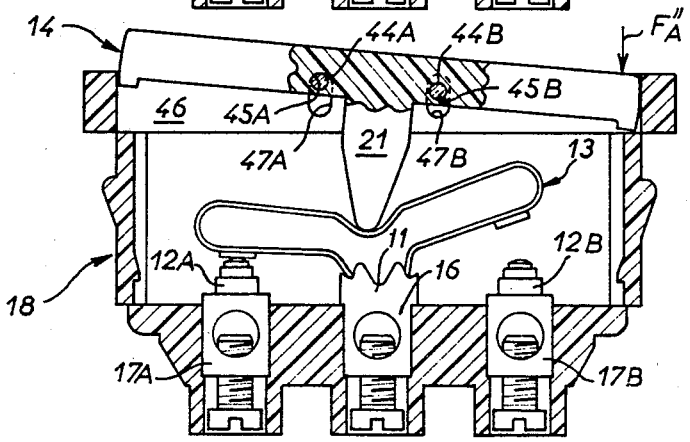

Likewise, if as shown by the arrow F"A in FIG. 20 the operating member 14 is operated on the side of the fixed contact 12B, the conductive contact arm 13 is applied against the fixed contact 12A.

However, both these extreme positions are unstable and to obtain them it is necessary to maintain the corresponding action on the operating member 14, as schematically represented by the arrows F"A and F"B.

Thus in this case the switch in accordance with the invention is a center-biased double-throw momentary action switch.

Figure 22:
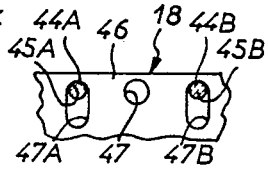

In practise, three bores 45, 45A, 45B may be systematically provided on the operating member 14 and three bores 47, 47A, 47B may be systematically provided on the housing 18, as shown in FIGS. 21 and 22.

Thus, depending on requirements, a single pivot pin 44, 44A or 44B is fitted to obtain either a switch with two stable open or closed positions, as in FIG. 11, or a switch with two open or closed positions of which only one is stable, as in FIG. 14, or a center-biased switch with two unstable closed positions, as in FIG. 17.

The advantageous result of this is some degree of standardization of implementation and great flexibility of utilization.

It will be understood that it is only to render the description easily understandable that the pivot axis or axes of the operating member employed in the embodiments of FIGS. 11 through 22 have been shown in the form of pins in these Figures.

Use could equally be made of trunnions or knife-edge pivots, for example, as previously.

Nor is the present invention limited to the embodiments described and shown, but rather encompasses any variant execution and/or combination of the various component parts thereof.

Also, there may be more than one conductive contact arm 13 for one and same operating member 14.

For example, as schematically represented in dashed outline in FIG. 12, there may be two parallel conductive contact arms 13 with, for each of them, a fixed yoke 11 and one or two fixed contacts 12A, 12B, the operating member 14 then having two parallel fingers 21 for operating them conjointly.

Given its mode of functioning which implies a speed of tilting of the conductive contact arm related to the speed at which the user operates the operating member, the switch mechanism in accordance with the invention is especially suited to switching alternating current, for which application it is more specifically intended, as such switching does not necessarily require high-speed tilting of the conductive contact arm. However, it goes without saying that the field of application of the invention is not limited to switching alternating current only, but may equally well encompass the switching of a direct current, in certain applications at least, especially where the current to be switched is small.

We claim:

1. A double pivot switch mechanism comprising an electrically conductive yoke having parallel pivoting areas, at least one fixed contact, an electrically conductive contact arm of resilient construction having a generally open loop configuration, ends of said open loop defining contact areas cooperable with said pivoting areas for articulating said conductive arm, said contact arm having a median strip having a depressed central part cooperable with an operating member for operating the switch mechanism in a first and a second position, said contact arm ends each projecting in a first direction and outwardly form the open loop, a bearing area being provided on said contact arm cooperable with said fixed contact in one of said two positions of the switch mechanism.

2. The switch mechanism according to claim 1, wherein said conductive contact arm comprises two said bearing areas, said median strip continuously connects said two bearing areas, said contact arm ends are formed on tabs.

3. The switch mechanism according to claim 2, wherein said pivoting areas of said fixed yoke are oriented in a first direction and said contact areas of said conductive contact arm are curved towards said pivoting areas.

4. The switch mechanism according to claim 2, wherein each of said tabs is in continuous contact with a corresponding one of said bearing areas, each of said tabs having a main part substantially coplanar with a corresponding one of the bearing areas, said median strip being generally M-shaped and each of the legs of said M-shaped median strip diverging from the plane of corresponding tabs.

5. The switch mechanism according to claim 4 wherein said conductive contact arm has two parallel tabs disposed on each side of said median strip and defining said contact arm ends.

6. The switch mechanism according to claim 1, wherein said depressed central part of said median strip is of substantially U or V-shaped configuration.

7. The switch mechanism according to claim 1 wherein said open loop of said conductive contact arm is of one piece construction.

8. The switch mechanism according to claim 1, wherein said operating member is pivotally mounted and its pivot axis is aligned with said fixed yoke.

9. The switch mechanism according to claim 1, wherein said operating member is pivotally mounted and its pivot axis is offset laterally relative to said fixed yoke.

10. The switch mechanism according to claim 1, wherein said operating member is pivotally mounted and has two pivot axes which are offset laterally relative to said fixed yoke, each pivot axis extending to one side of said fixed yoke.

11. The switch mechanism according to claim 1, wherein said operating member is mounted for translatory movement and is offset relative to said fixed yoke.

12. The switch according to claim 1, wherein said projecting ends of said contact arm extend generally in a direction away from said operating member.

13. The switch according to claim 1, wherein said projecting ends are freely received in notches opening in the general direction of the operating member, and said pivoting areas being defined by bottom walls of said notches.

14. The switch according to claim 1, wherein said contact areas consist essentially of free edges of said contact arm projecting ends.

15. The switch according to claim 1, wherein a U-shaped connecting area continuously connects each end of the median strip to a corresponding one of said contact areas, each of said U-shaped connecting areas including a leg spaced from and opposite to said median strip, each of said legs having a said bearing area cooperable with a said fixed contact.

16. A double pivot switch mechanism comprising an electrically conductive fixed yoke having two parallel pivoting areas, at least one fixed contact, an electrically conductive contact arm having a generally open loop configuration, ends of said open loop defining contact areas cooperable with said pivoting areas for articulating the conductive arm, said contact arm comprising a median strip cooperable with an operating member for operating the switch mechanism in a first and a second position, U-shaped connecting areas being continuously connected to ends of said median strip to said contact areas, at least one of said U-shaped connecting areas including a leg opposite from said median strip having a bearing area cooperable with the fixed contact in one of the two positions of the switch mechanism.

17. The switch mechanism according to claim 16, wherein said pivoting areas of said fixed yoke are in back-to-back relationship and said contact areas of said conductive contact arm are straight.

18. A switch comprising a housing, a switch mechanism mounted in said housing and an operating member for operating said switch mechanism, said switch mechanism comprising an electrically conductive yoke having parallel pivoting areas, at least one fixed contact, an electrically conductive contact arm of resilient construction having a generally open loop configuration, ends of said open loop defining contact areas cooperable with said pivoting areas for articulating said conductive arm, said contact arm having a median strip having a depressed central part cooperable with the operating member for operating the switch mechanism in a first and a second position, said contact arm ends projecting in the same direction and outwardly from the open loop, a bearing area being provided on said contact arm cooperable with said fixed contact in one of said two positions of the switch mechanism.

19. The switch according to claim 18, wherein said switch mechanism comprises two pivot pins offset laterally relative to said fixed yoke and bores in said housing through which paid pivot pins are received with clearance.

20. The switch according to claim 18, wherein said operating member is pivotally mounted and comprises three bores, each of said bores receiving a pivot pin, said housing having three corresponding bores.

* * * * *